US005674078A

United States Patent [19]

Davis et al.

[11] Patent Number: 5,674,078

[45] Date of Patent: Oct. 7, 1997

[54] MULTI-DIRECTIONAL INTERFACE HEADER ASSEMBLY

[75] Inventors: Wayne Samuel Davis, Harrisburg; Richard James Conrad, Carlisle, both of Pa.

[73] Assignee: The Whitaker Corporation, Wilmington, Del.

[21] Appl. No.: 590,310

[22] Filed: Jan. 23, 1996

[51] Int. Cl.[6] ..... H01R 9/09

[52] U.S. Cl. ..... 439/79

[58] Field of Search ..... 439/11, 12, 65, 439/79, 284, 287

[56] References Cited

U.S. PATENT DOCUMENTS

| | | | |
|---|---|---|---|
| 4,457,570 | 7/1984 | Bogese, II . | |
| 4,632,475 | 12/1986 | Tomita . | |
| 4,715,819 | 12/1987 | Iwasa et al. | 439/31 |
| 4,865,553 | 9/1989 | Tanigawa et al. | 439/31 |
| 4,907,987 | 3/1990 | Douty et al. | 439/571 |
| 4,975,062 | 12/1990 | Evans et al. | 439/13 |
| 5,004,434 | 4/1991 | Aiello et al. | 439/636 |
| 5,176,526 | 1/1993 | Hillbish et al. | 439/108 |
| 5,470,255 | 11/1995 | McCleerey et al. | 439/500 |

FOREIGN PATENT DOCUMENTS

| | | | |
|---|---|---|---|
| 0142922 A1 | 5/1985 | European Pat. Off. | H01R 35/04 |
| 0 353 421 | 8/1989 | European Pat. Off. | H01R 23/70 |
| 0347097 A1 | 12/1989 | European Pat. Off. | H01R 23/68 |
| 2189658 A | 10/1987 | United Kingdom | H01R 13/46 |

OTHER PUBLICATIONS

US Patent Application Ser. No. 08/358271 filed Dec. 19, 1994 (Abstract and Drawings only included).

US Patent Application Ser. No. 07/850,733 filed Mar. 13, 1992 (Abstract and Drawings only included).

*Journal of Electronic Engineering No. 254*, "Board-to Board Connectors Increasingly Used for Consumer Products"; Tanaka; Feb., 1988; p. 30–35; Tokyo, Japan.

International Search Report, PCT/US97/01359 (corresponding application) dated May 28, 1997; four pages.

*Primary Examiner*—Khiem Nguyen

*Attorney, Agent, or Firm*—Anton P. Ness

[57] ABSTRACT

An electrical connector header assembly adapted for mounting on a printed circuit board so as to allow multi-directional mating contact with a complementary connector receptacle assembly includes a box-like insulated housing with contact receiving cavities therein. Each of the cavities is generally planar and is open to the front, rear and bottom surfaces of the housing, with the main portions of the cavities being parallel to each other and to the lateral surfaces of the housing. Each cavity also has a second, subsidiary, portion extending laterally from the main portion and open to the rear surface. The assembly further includes electrical contacts received in respective ones of the cavities. Each of the contacts is generally planar so as to fit within the planar cavity except for the laterally bent tab which extends into the cavity second portion. Each contact has a forward blade portion which extends beyond the front surface of the housing and which also extends beyond the bottom surface of the housing. Thus, the cavity being open along the bottom surface of the housing allows the contact to be inserted blade portion first from the rear surface of the housing. The bent tab prevents vertical movement of the contact and interference between the forward edge of the tab and a front wall of the cavity second portion limits forward movement of the contact. Interference members prevent rearward movement of the contact.

8 Claims, 5 Drawing Sheets

MULTI-DIRECTIONAL INTERFACE HEADER ASSEMBLY

BACKGROUND OF THE INVENTION

This invention relates to electrical connectors and, more particularly, to an electrical connector header assembly adapted for mounting on a printed circuit board to allow multi-directional mating contact with a complementary connector receptacle assembly. U.S. Pat. No. 5,551,883, discloses an electrical connector for a package, such as a battery pack, adapted to mate with a header mounted to a circuit board. The aforereferenced application further discloses an exemplary header. It is often a requirement that the receptacle connector of the package be receivable by a header to allow mating thereof horizontally, vertically, or anywhere in between, i.e., the header providing a multi-directional interface.

When designing an electrical connector header assembly for a particular application, there are numerous packaging constraints that must be satisfied. It is typical to have dimensional restrictions for the header assembly, usually related to the maximum size of the header assembly housing. Even when such size restrictions are in place, there are still requirements that the package be rugged and that multi-directional mating be provided for.

It is therefore an object of the present invention to provide an electrical connector header assembly in a compact housing which allows multi-directional mating with a complementary connector receptacle assembly.

SUMMARY OF THE INVENTION

The foregoing and additional objects are attained in accordance with the principles of this invention by providing an electrical connector header assembly adapted for mounting on a circuit board so as to allow multi-directional mating contact with a complementary connector receptacle assembly. The header assembly comprises an insulated housing of generally hexahedral shape. The housing has a front surface, a rear surface, a top surface, a bottom surface and a pair of lateral surfaces, as well as having at least one contact receiving cavity therein. Each of the cavities has a generally planar first portion open to the front, rear and bottom surfaces of the housing, with the plane of the first cavity portion being substantially parallel to the pair of lateral surfaces. Each cavity further has a second portion extending laterally from the first portion and open to the rear surface. The header assembly further includes at least one electrical contact received in a respective one of the cavities. Each contact has a blade portion, a body portion and a terminal portion. The body portion has a generally planar main portion within the respective cavity first portion and a laterally bent tab extending from the body main portion into the respective cavity second portion. The terminal portion of the contact is generally co-planar with the body main portion and extends out of the respective cavity beyond the bottom surface of the housing. The blade portion of the contact is generally co-planar with the body main portion and extends out of the respective cavity beyond the front surface of the housing. That part of the blade portion which extends out of the cavity has a lower edge spaced vertically beyond the bottom surface of the housing. Thus, the contact is inserted blade portion first into its respective cavity from the rear surface of the housing, with the blade portion extending out of the respective cavity beyond the bottom surface of the housing. The bent tab prevents vertical movement of the contact within the cavity.

In accordance with an aspect of this invention, the upper edge of the contact is formed substantially as a straight line, and the body main portion of the contact is formed with at least one rearwardly directed barb on the upper edge to engage an upper wall of the cavity and interfere with removal of the contact from the cavity. Thus, rearward movement of the contact is prevented.

In accordance with a further aspect of this invention, each cavity second portion has a front wall against which a forward edge of the contact tab abuts to provide a forward limit for insertion of the contact into the respective cavity. Thus, forward movement of the contact is prevented.

Accordingly, front and back horizontal movement and vertical movement of the contact is prevented once the contact is inserted into its cavity, with the side walls of the cavity preventing lateral horizontal movement. All of this is accomplished by a compact housing which leaves the blade portion of the contacts exposed for multi-directional mating with a complementary connector receptacle assembly.

BRIEF DESCRIPTION OF THE DRAWINGS

The foregoing will be more readily apparent upon reading the following description in conjunction with the drawings in which like elements in different figures thereof are identified by the same reference numeral and wherein:

FIG. 3 is a front top isometric view of an electrical contact for the housing of FIGS. 1 and 2;

DETAILED DESCRIPTION

Figure 1:
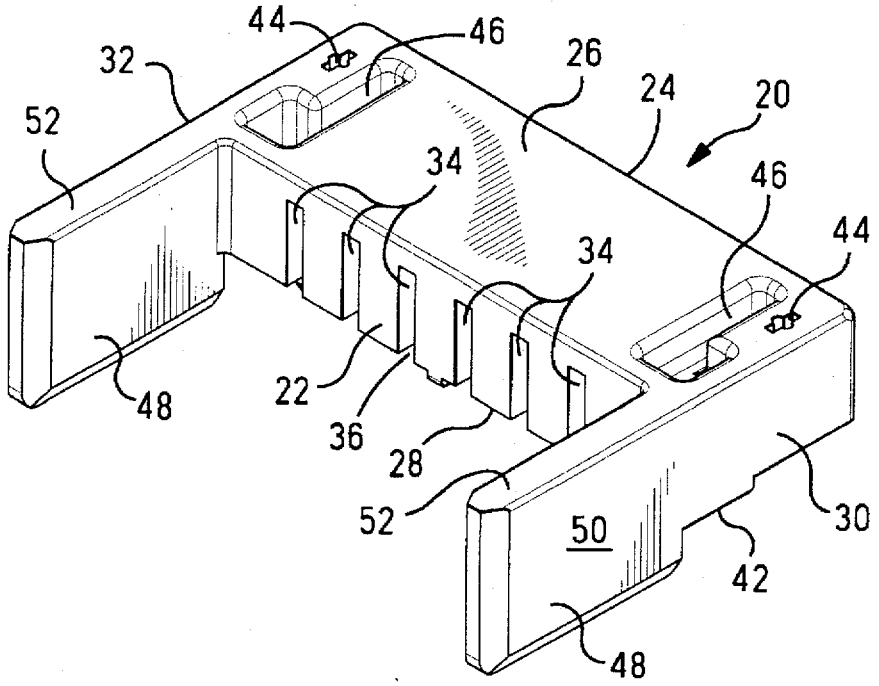
FIG. 1 is a top front isometric view of a housing for an electrical connector header assembly according to the present invention.

Referring now to the drawings, shown therein is an electrical connector header assembly according to the present invention which is adapted for mounting on a circuit board. For discussion purposes, the vertical direction will be considered to be orthogonal to the surface of the circuit board and the horizontal direction will be considered to be parallel to the circuit board surface, with the bottom of the header assembly housing being the side of the housing which is adjacent to the circuit board and the front of the housing being the mating face of the header assembly.

Figure 2:
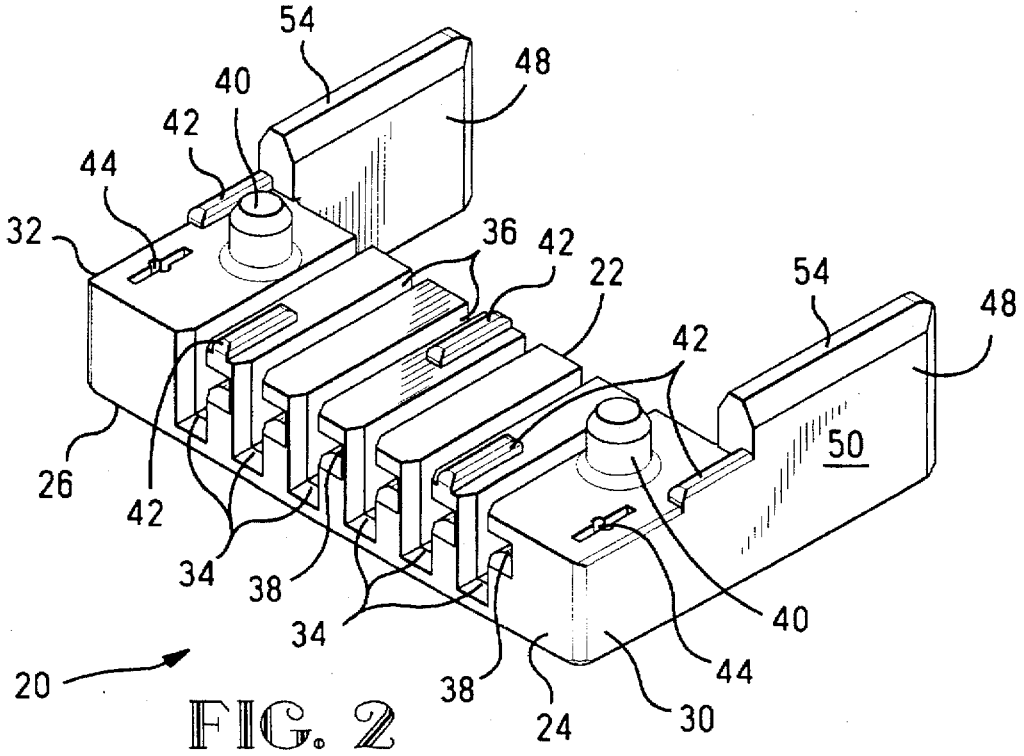
FIG. 2 is a bottom rear isometric view of the housing.

As shown in the drawings, the header assembly includes an insulated housing, identified generally by the reference numeral 20, which is preferably molded of a plastic material, and which is of generally hexahedral (six sided) shape. Thus, the housing 20 has a front surface 22, a rear surface 24, a top surface 26, a bottom surface 28, and a pair of lateral surfaces 30, 32. As shown, the housing 20 has six contact receiving cavities 34, although the present invention is not limited to any specific number. Each of the cavities 34 has a generally planar first, or main, portion 36 which is open to the front surface 22, the rear surface 24, and the bottom surface 28 of the housing 20. The plane of the cavity first portion 36 is substantially parallel to the lateral surfaces 30, 32 of the housing 20 and its width is sufficient to allow a contact, to be described hereinafter, to be received therein with minimum clearance. Each cavity 34 further includes a second, or subsidiary, portion 38 which extends laterally from the first portion 36 and is open to the rear surface 24 of the housing 20. Where the cavities 34 intersect the rear surface 24 of the housing 20, the housing 20 is preferably chamfered, as clearly shown in FIG. 2, to provide for easy insertion of a contact.

The housing 20 is further formed with a pair of alignment posts 40 extending orthogonally from the bottom surface 28 and adapted to extend through openings in a circuit board, as is conventional in the art. In addition, the housing 20 is formed with a plurality of standoffs 42 to space the bottom surface 28 from the mounting surface of a circuit board so as to allow for cleaning after the contacts are soldered to the circuit board, as is conventional in the art. Still further, the housing 20 is formed with a pair of spaced through-apertures 44 adapted to contain board locks (such as disclosed in U.S. patent application Ser. No. 07/850,733, filed Mar. 13, 1992, and now abandoned) which project beyond the bottom surface 28 of the housing 20. A pair of void cores 46 are also formed in the housing 20, as is conventional in the art, in order to maintain a substantial uniformity of wall thickness.

As will be described in full detail hereinafter, the housing 20 is also formed with a pair of forwardly extending planar side walls 48. The outer surface 50 of each of the side walls 48 is co-planar with a respective lateral surface 30, 32 of the housing 20. The top edge 52 of each of the side walls 48 is a straight line which is an extension of the top surface 26 of the housing 20. However, the bottom edge 54 of each of the side walls 48 extends below the bottom surface 28 of the housing 20, for a reason which will be explained hereinafter.

FIG. 3 illustrates an electrical contact, identified generally by the reference numeral 56, which is receivable within a cavity 0.34 of the housing 20. Preferably, the contact 56 is stamped and formed from conductive sheet material and, if desired, may be selectively plated in localized areas to enhance mating contact with a complementary connector and solderability. In any event, the contact 56 is generally planar and includes a blade portion 58, a body portion 60, and a terminal portion 62. The body portion 60 includes a generally planar main portion 64 and a laterally bent tab 66. The blade portion 58, the body main portion 64, and the terminal portion 62 are all co-planar, and the tab 66 extends orthogonally thereto. The upper edge 68 of the contact 56 is formed substantially as a straight line. Along the upper edge 68, the body main portion 64 is formed with a pair of rearwardly directed barbs 70, the blade portion 58 being considered to be at the forward end of the contact 56. Further, the distal edge 72 of the tab 66 is also formed with a pair of rearwardly directed barbs 74.

Figure 8:
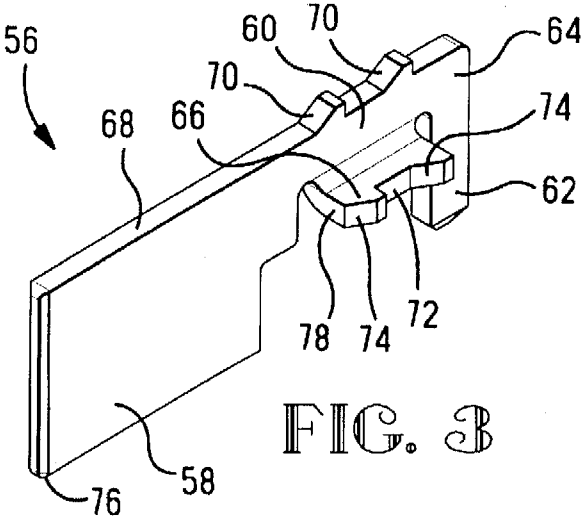
FIG. 8 is a cross sectional view taken along the line 8—8 in FIG. 6.
Figure 7:
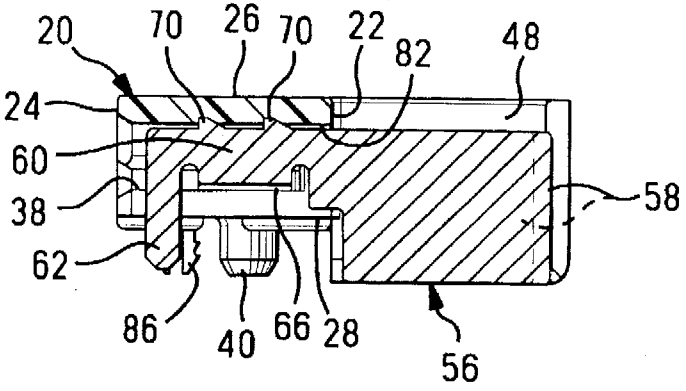
FIG. 7 is a cross sectional view taken along the line 7—7 in FIG. 6.
Figure 6:
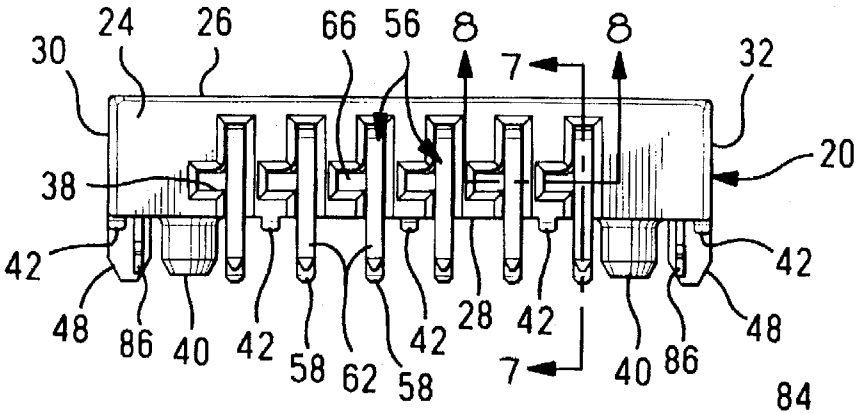
FIG. 6 is a rear elevational view of the complete header assembly.
Figure 8:
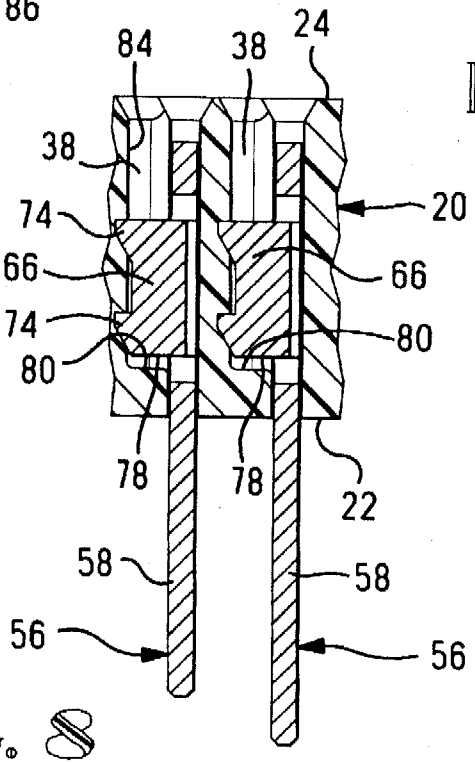

To assemble the electrical connector header assembly, each of the contacts 56 is inserted, blade portion 58 first, into its respective cavity 34. It is noted that there is only one orientation in which the contact 56 can be inserted into the cavity, since the tab 66 and the cavity second portion 38 form a keying arrangement. The vertical dimension of the blade portion 58 from the upper edge 68 to the lower edge 76 is greater than the height of the cavity 34 so that a lower region of the blade portion 58 extends beyond the bottom surface 28 of the housing 20 as the contact 56 is inserted into the cavity 34. Similarly, the terminal portion 62 of the contact 56 also extends beyond the bottom surface 28. Insertion of the contact 56 from the rear surface 24 of the housing 20 results in the tab 66 being received in the cavity second portion 38, with forward positioning of the contact 56 being limited to the point where the forward edge 78 of the tab 66 abuts the front wall 80 of the cavity second portion 38 (FIG. 8). The barbs 70 on the upper edge 68 of the contact 56 engage the upper wall 82 (FIG. 7) of the cavity first portion 36 to interfere with rearward movement (i.e., removal) of the contact 56. Such removal interference is aided by the barbs 74 on the tab 66 which engage the side wall 84 of the cavity second portion 38 (FIG. 8). Vertical movement of the contact 56 within the cavity 34 is prevented by the tab 66 engaging the upper and lower walls of the cavity second portion 38.

Assembly is completed by inserting a pair of board locks 86 each in a respective one of the apertures 44 provided therefor. As is known, the board locks 86 hold the header assembly in the circuit board until the terminal portions 62 of the contact 56 are soldered in place.

Figure 4:
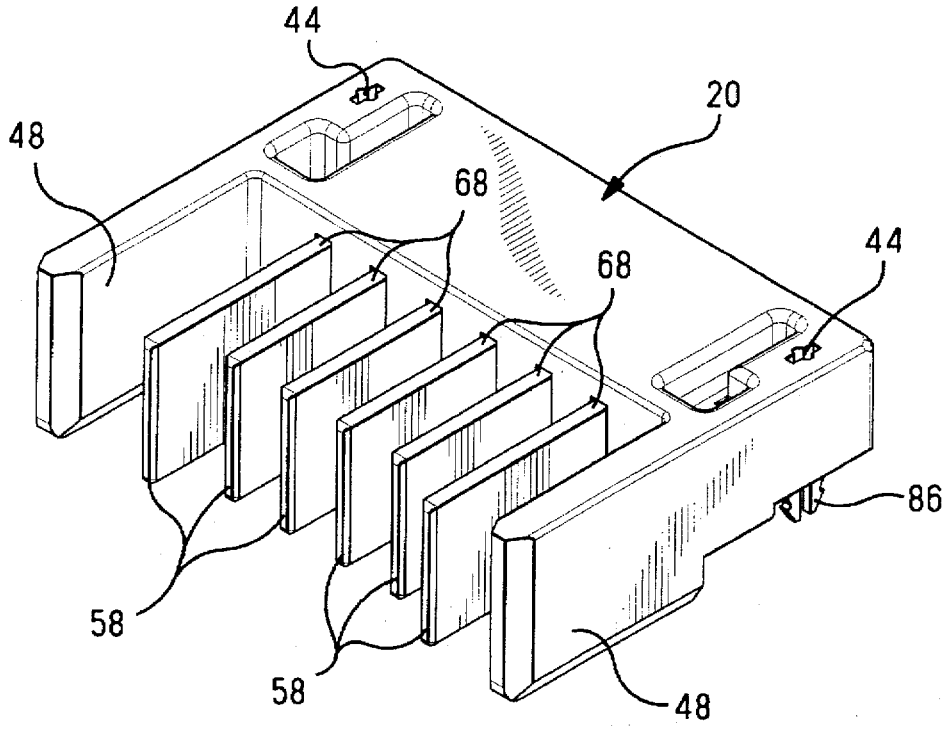
FIG. 4 is a top front isometric view of a complete header assembly using the housing and contact of FIGS. 1–3.
Figure 5:
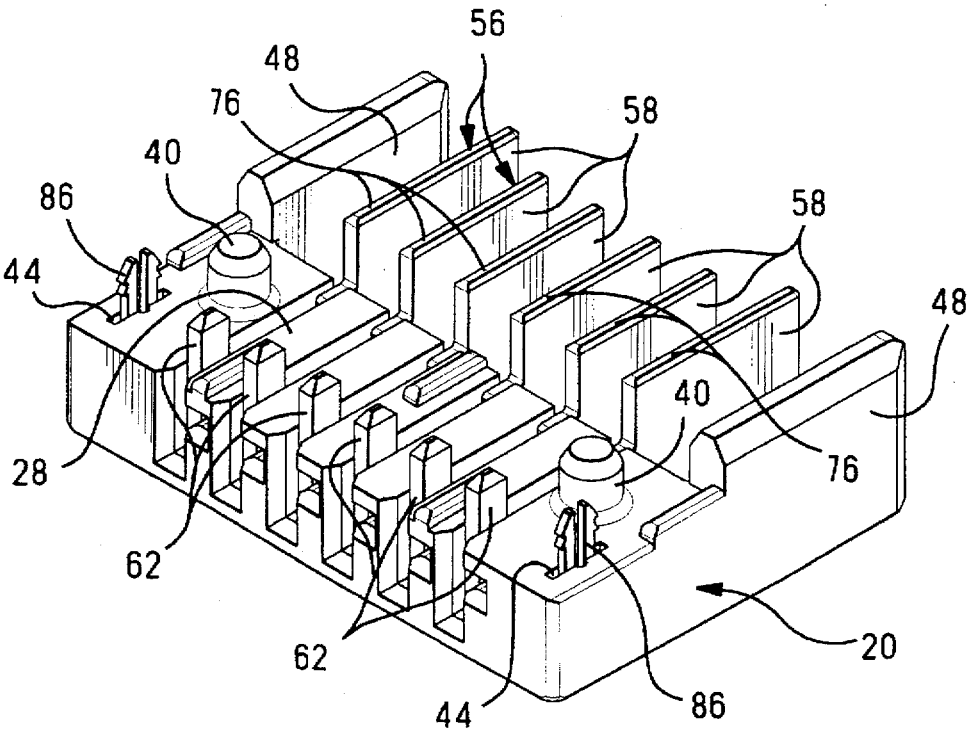
FIG. 5 is a bottom rear isometric view of the complete header assembly.

As best shown in FIGS. 4, 5 and 8, the blade portions 58 of the two outer contacts 56 have a greater horizontal dimension than the four inner contact blade portions 58, thereby extending further forwardly beyond the front surface 22 of the housing 20. This insures that those outer contacts 56 make before and break after the inner contacts 56 when mating and unmating, respectively, with a complementary receptacle assembly. Although in the illustrative embodiment disclosed herein it is the two outer contacts which are shown as making first and breaking last, it is understood that in a particular application any one or more of the contacts can be so arranged.

The side walls 48 of the housing 20 have two functions. The first function is to provide an alignment with the mating receptacle assembly, which would be designed to accommodate the side walls 48. The second function of the side walls 48 is to provide protection for the contacts 56, which have their enlarged blade portions 58 totally exposed, since lateral engagement with a blade portion 58 could damage the header assembly by bending the blade portion 58 out of alignment. Thus, to prevent such lateral engagement, the side walls 48 have a horizontal dimension and a vertical dimension each at least as great as the respective largest horizontal and vertical dimensions of that part of a blade portion 58 which extends out of its respective cavity 34 beyond the front surface 22 of the housing 20. Therefore, when an image of each of the blade portions 58 is projected orthogonally laterally onto a side wall 48, such projected image is contained entirely within the side wall 48.

Figure 9:
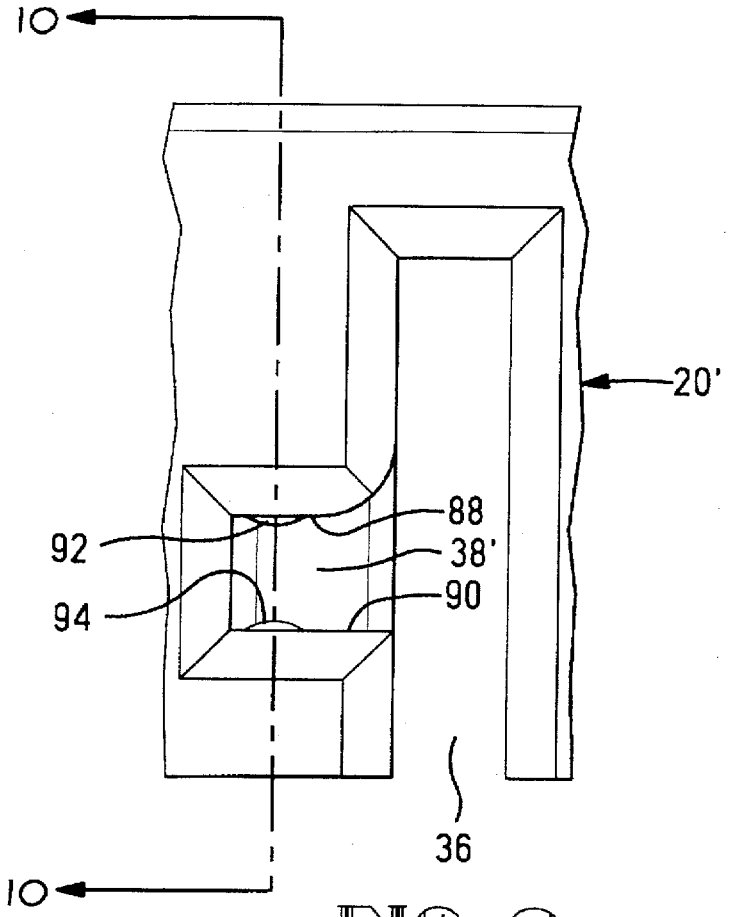
FIG. 9 is an enlarged rear elevational view of a portion of the housing showing an alternative embodiment which eliminates the barbs on the contact.
Figure 10:
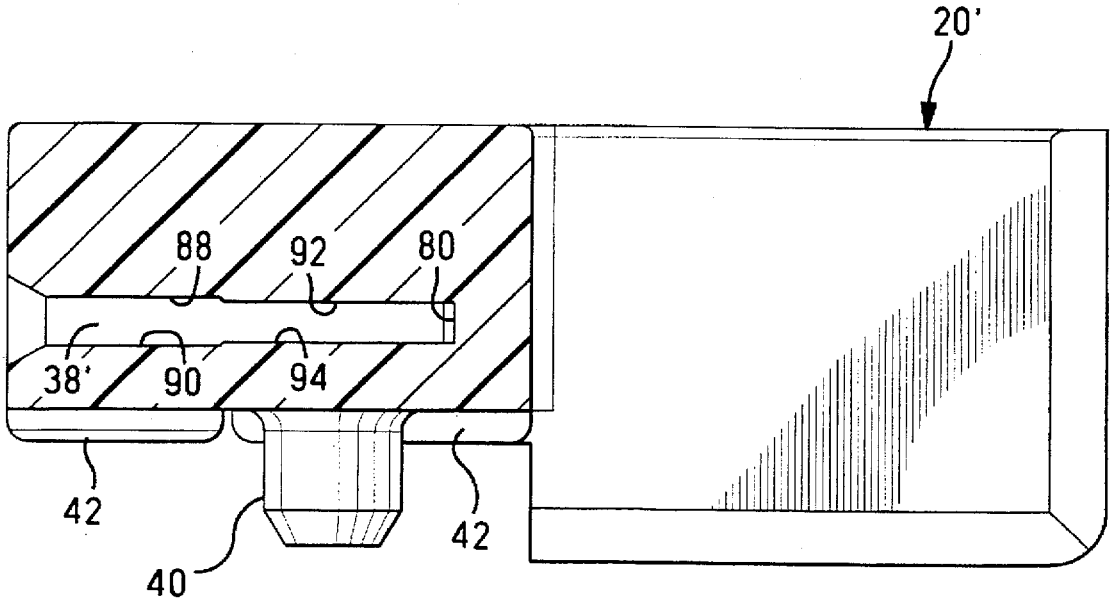
FIG. 10 is a cross sectional view taken along the line 10—10 in FIG. 9.

FIGS. 9 and 10 show an alternate embodiment to the disclosed header assembly wherein the barbs 70, 74 are eliminated. Thus, in this alternate embodiment, the upper edge 68 of the contact 56 of FIG. 3 and the distal edge 72 of the tab 66 of the contact 56 would both be flat. The modified housing 20' differs from the previously described housing 20 by changing the upper wall 88 and the lower wall 90 of the modified cavity second portion 38' to each have a respective rib 92, 94 thereon. As shown in FIGS. 9 and 10, the ribs 92, 94 are elongated in a direction substantially parallel to the lateral surfaces 30, 32 of the housing 20'. These ribs 92, 94 provide an interference fit for the tab 66 of the contact 56. Preferably, as best seen in FIG. 9, the ribs 92, 94 are opposed one to the other in a plane substantially parallel to the lateral surfaces 30, 32 of the housing 20'. By having the ribs 92, 94 so opposed, there is no unbalanced force imposed on the tab 66 which would tend to tilt the tab 66 and the contact 56. When using interference ribs such as shown in FIGS. 9 and 10, it is desired to maintain the interference only in a vertical orientation. This is because if the interference were to be horizontal across the cavity first portion 36, due to the open bottom of the cavity 34 the housing 20 would tend to curvingly deform.

Figure 11:
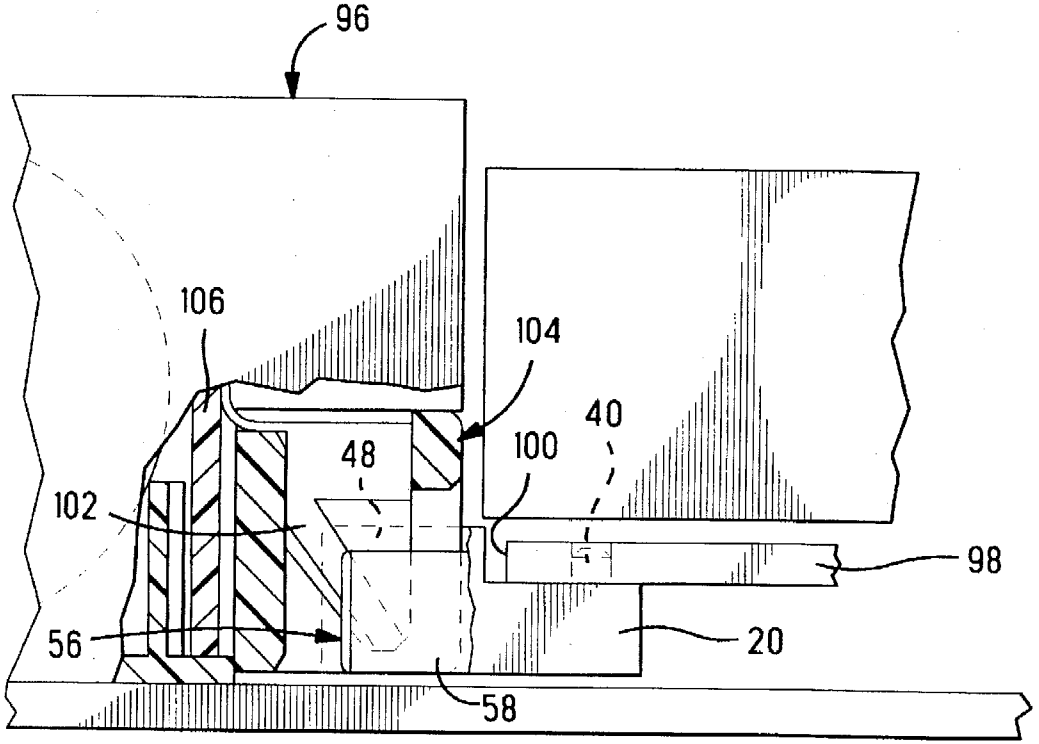
FIG. 11 shows an illustrative environment in which the header assembly according to this invention may be utilized.

FIG. 11 depicts the connection of a battery pack 96 to a system including a circuit board 98 on which an electrical connector header assembly according to the present invention is mounted. The mounting of the header assembly to the circuit board 98 is such that the side walls 48 and the blade portions 58 of the contact 56 extend beyond the edge 100 of the circuit board 94. Therefore, the blade portions 58 are exposed for horizontal or vertical mating with a contact 102 of a complementary connector receptacle assembly 104 mounted to a circuit board 106 within a battery pack 96, such as a receptacle assembly of the type disclosed in the aforereferenced U.S. Pat. No. 5,551,883.

Thus, as shown in FIG. 11, the electrical connector header assembly according to the present invention is designed to fit within a relatively small, confined space by providing a compact housing which allows the multi-directional mating and ruggedly secures the contacts therein.

Accordingly, there has been disclosed an improved electrical connector header assembly adapted for mounting on a circuit board so as to allow multi-directional mating contact with a complementary connector receptacle assembly. While illustrative embodiments of the inventive assembly have been disclosed herein, it is understood that various modifications and adaptations to the disclosed embodiments will be apparent to those of ordinary skill in the art and it is intended that this invention only be limited by the scope of the appended claims.

What is claimed is:

1. An electrical connector header assembly adapted for mounting on a circuit board so as to allow multi-directional mating contact with a complementary connector receptacle assembly, comprising:

an insulated housing of generally hexahedral shape having a front surface, a rear surface, a top surface, a bottom surface and a pair of lateral surfaces, the housing having at least one contact receiving cavity therein, each of the at least one cavity having a generally planar first portion open to the front, rear and bottom surfaces of the housing, the plane of the first portion being substantially parallel to said pair of lateral surfaces, and each of the at least one cavity having a second portion extending laterally from said first portion and open to said rear surface; and at least one electrical contact received in a respective one of said at least one cavity, each of said at least one contact including a blade portion, a body portion and a terminal portion, the body portion having a generally planar main portion within the respective cavity first portion and a laterally bent tab extending from said body main portion into the respective cavity second portion, the terminal portion being generally co-planar with said body main portion and extending out of said respective cavity beyond said housing bottom surface, and said blade portion being generally co-planar with said body main portion and extending out of said respective cavity beyond said housing front surface, that part of said blade portion which extends out of said respective cavity having a lower edge spaced vertically beyond said housing bottom surface;

wherein said at least one contact is inserted blade portion first into said respective cavity from said housing rear surface, with said blade portion extending out of said respective cavity beyond said housing bottom surface.

2. The header assembly according to claim 1 wherein the upper edge of said at least one contact is formed substantially as a straight line, and said at least one contact body main portion is formed with at least one rearwardly directed barb on said upper edge to engage an upper wall of said respective cavity first portion and interfere with removal of said at least one contact from said respective cavity.

3. The header assembly according to claim 1 wherein said at least one contact tab is formed with at least one rearwardly directed barb on a distal edge to engage a side wall of said respective cavity second portion and interfere with removal of said at least one contact from said respective cavity.

4. The header assembly according to claim 1 wherein said respective cavity second portion has formed on each of a pair of opposed wall surfaces a rib extending into said respective cavity second portion, each of said ribs being elongated in a direction substantially parallel to said housing lateral surfaces, wherein said pair of ribs provide an interference fit for said at least one contact tab.

5. The header assembly according to claim 4 wherein said at least one contact tab extends orthogonally to said at least one contact body main portion, said respective cavity second portion extending orthogonally to said respective cavity first portion so as to have an upper wall and a lower wall each with one of said pair of ribs thereon, and said pair of ribs are opposed one to the other in a plane substantially parallel to said housing lateral surfaces.

6. The header assembly according to claim 1 wherein said respective cavity second portion has a front wall against which a forward edge of said at least one contact tab abuts to provide a forward limit for insertion of said at least one contact into said respective cavity.

7. The header assembly according to claim 1 wherein said housing further includes a pair of forwardly extending planar side walls, each of said side walls having an outer surface co-planar with a respective housing lateral surface, and each of said side walls having a horizontal dimension and a vertical dimension each at least as great as the respective largest horizontal and vertical dimensions of that part of said at least one contact blade portion which extends out of said respective cavity so that an orthogonally lateral image projection of said at least one contact blade portion is entirely contained on said each side wall.

8. The header assembly according to claim 1 wherein there are a plurality of parallel side-by-side contact receiving cavities in said housing and an equal plurality of electrical contacts each in a respective one of said cavities, each of the contacts being in either a first group of at least one contact or a second group of at least one contact, and the blade portion of each of the contacts in said first group extends further beyond said housing front surface than the blade portion of each of the contacts in said second group so that the contacts of said first group make before and break after the contacts of said second group when mating and unmating, respectively, with said receptacle assembly.

* * * * *